US008960048B2

(12) United States Patent
Souza et al.

(10) Patent No.: US 8,960,048 B2
(45) Date of Patent: Feb. 24, 2015

(54) ACCELERATOR PEDAL ADJUSTMENT MECHANISM

(75) Inventors: Bruno Souza, Sao Jose Dos Campos (BR); Fernando Burguera, Bilbao (ES)

(73) Assignee: Batz S. Coop, Igorre (ES)

( * ) Notice: Subject to any disclaimer, the term of this patent is extended or adjusted under 35 U.S.C. 154(b) by 1496 days.

(21) Appl. No.: 11/988,590

(22) PCT Filed: Jul. 17, 2006

(86) PCT No.: PCT/ES2006/070107

§ 371 (c)(1), (2), (4) Date: Mar. 24, 2009

(87) PCT Pub. No.: WO2007/010079

PCT Pub. Date: Jan. 25, 2007

(65) Prior Publication Data

US 2009/0193928 A1 Aug. 6, 2009

(30) Foreign Application Priority Data

Jul. 19, 2005 (ES) ..... 200501756

(51) Int. Cl.
*G05G 1/405* (2008.04)

(52) U.S. Cl.
CPC ..... *G05G 1/405* (2013.01)
USPC ..... 74/512; 74/513; 74/514; 74/560

(58) Field of Classification Search
CPC ..... B60T 7/06; B60T 7/04
USPC ..... 74/512–514, 560–562.5
IPC ..... G05G 1/40, 1/405
See application file for complete search history.

(56) References Cited

U.S. PATENT DOCUMENTS

| | | | | |
|---|---|---|---|---|
| 3,643,525 | A | 2/1972 | Gibas | |
| 4,875,385 | A * | 10/1989 | Sitrin | 74/512 |
| 6,289,761 | B1 * | 9/2001 | Reynolds et al. | 74/512 |
| 6,389,927 | B1 | 5/2002 | Willemsen | |
| 6,571,660 | B2 * | 6/2003 | Gmurowski et al. | 74/512 |

(Continued)

FOREIGN PATENT DOCUMENTS

| | | | |
|---|---|---|---|
| EP | 1251417 | A1 | 10/2002 |
| JP | 2002196835 | A * | 7/2002 |

(Continued)

OTHER PUBLICATIONS

International Search Report for International Application No. PCT/ES2006/070107.

*Primary Examiner* — Daniel Yabut
(74) *Attorney, Agent, or Firm* — Tim L. Kitchen; Peter B. Scull; Hamilton DeSanctis & Cha, LLP

(57) ABSTRACT

A mechanism for the adjustment of an accelerator pedal, comprising a support part (2) which is fixed to the vehicle, a control part (3) which can move in relation to the support part (2), a pedal (4) which pivots in relation to a rotary shaft (5) which is connected to the control part (3), and actuation means (6) for moving the control part (3) in relation to the support part (2). Each side of the control part (3) is equipped with at least two pins (7,8) which are housed in respective guide grooves (9,10) in the support part (2), such that the actuation means (6) can move said control part (2) along a curvilinear path.

8 Claims, 6 Drawing Sheets

(56) References Cited

U.S. PATENT DOCUMENTS

| | | | | |
|---|---|---|---|---|
| 6,782,775 | B2 * | 8/2004 | Hayashihara | 74/512 |
| 6,782,776 | B2 * | 8/2004 | Oberheide et al. | 74/512 |
| 6,952,980 | B2 * | 10/2005 | Hayashihara et al. | 74/512 |
| 2002/0148322 | A1 * | 10/2002 | Gmurowski et al. | 74/512 |
| 2003/0084749 | A1 * | 5/2003 | Orr et al. | 74/560 |
| 2004/0040403 | A1 | 3/2004 | Hayashihara et al. | |

FOREIGN PATENT DOCUMENTS

| | | | |
|---|---|---|---|
| WO | WO2004048169 | A1 | 6/2004 |
| WO | WO2004049091 | A1 | 6/2004 |

* cited by examiner

ACCELERATOR PEDAL ADJUSTMENT MECHANISM

CROSS REFERENCE TO RELATED APPLICATION

This application is a U.S. national phase application under 35 U.S.C. §371 of International Application No. PCT/ES2006/070107 filed Jul. 17, 2006, which claims priority to foreign application SPAIN P 200501756 filed Jul. 19, 2005 both of which are herein incorporated by reference in their entirety.

TECHNICAL FIELD

The present invention relates to motor vehicle pedal adjustment mechanisms, and more specifically to accelerator pedal adjustment mechanisms.

PRIOR ART

There are different types of known motor vehicle pedal adjustment mechanisms that enable the pedals to be disposed in different positions so that they may be adapted to the physical characteristics of the driver.

U.S. Pat. No. 3,643,525 A discloses a pedal adjustment mechanism that comprises actuation means by means of which both the brake pedal and the accelerator pedal may be moved for their positioning along a rectilinear trajectory.

U.S. Pat. No. 6,389,927 B1 discloses a pedal adjustment mechanism that comprises a support part that is fixed to the motor vehicle, a control part which can move in relation to said support piece, a pedal that pivots in relation to a rotary shaft connected to said control part, and actuation means for moving the control part in relation to the support piece.

In said adjustment mechanism, the control part comprises an upper arm connected to a horizontal arm of the support part by means of a rotary shaft. Thus, by means of the actuation means said control part may be pivoted in relation to said rotary shaft, thereby moving the pedal along a trajectory in the form of an arc of circumference.

DISCLOSURE OF THE INVENTION

It is the object of this invention to provide an accelerator pedal adjustment mechanism that enables the pedal to be moved along a curvilinear path.

The adjustment mechanism of the invention comprises a support part that is fixed to the motor vehicle, a control part which can move in relation to said support piece, a pedal which pivots in relation to a rotary shaft connected to said control part, and actuation means for moving the control part in relation to the support piece.

The control part is equipped, on each side, at least with two pins which are housed in respective guide grooves in the support piece, such that the actuation means can move said control part and, therefore, the pedal itself, along a curvilinear path.

The adjustment mechanism of the invention may be designed in accordance with the manufacturer's premises in relation to the possible positions of the pedal. Thus, once the end positions of the pedal have been fixed, the adjustment mechanism of the invention can be implemented in a simple way. Furthermore, the orientation of the pedal in the end positions is not limited by the fact that the control part has to pivot in relation to a rotary shaft. In addition, the adjustment mechanism of the invention can also be adapted to predetermined intermediate positions giving the requisite shape to the guide grooves.

These and other advantages and characteristics of the invention will be made evident in the light of the drawings and the detailed description thereof.

DETAILED DISCLOSURE OF THE INVENTION

Figure 1:
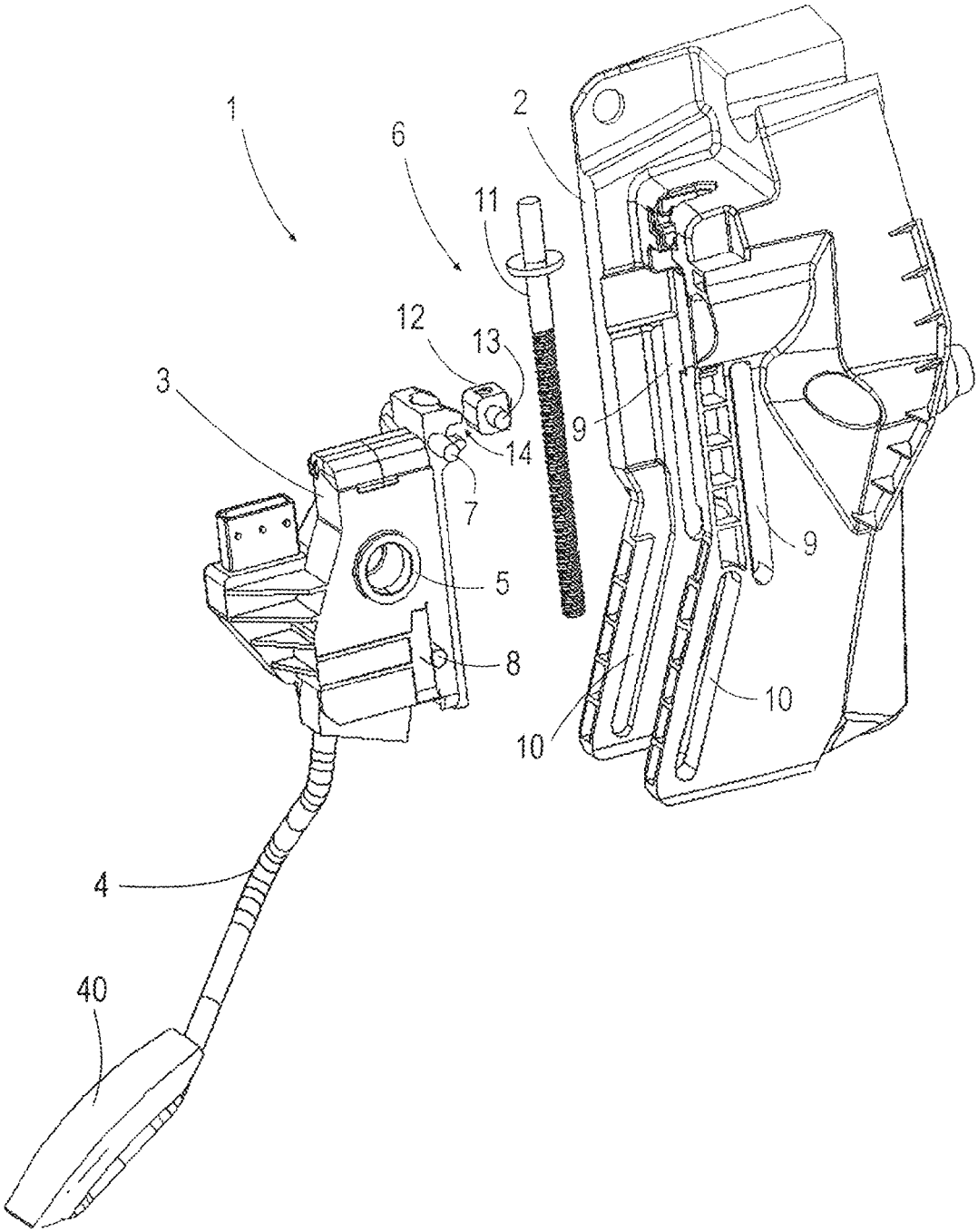
FIG. 1 is an exploded view of an embodiment of the invention.

As it is shown in FIG. 1, the adjustment mechanism 1 of the invention comprises a support part 2 that is fixed to the wall (not shown in the figures) which separates the engine of the motor vehicle from the passenger compartment, a control part 3 which can move in relation to said support part 2, a pedal 4 that comprises a shoe 40 and which pivots in relation to an rotary shaft 5 connected to said control part 3, and actuation means 6 for moving the control part 3 in relation to the support part 2.

In this embodiment, the control part 3 has on each side two pins 7 and 8 which are housed in respective guide grooves 9 and 10 in the support part 2. Thus, the actuation means 6 can move said control part 2, and, therefore, the pedal 4 itself, along a curvilinear path as it is shown in FIG. 2.

Figure 3:
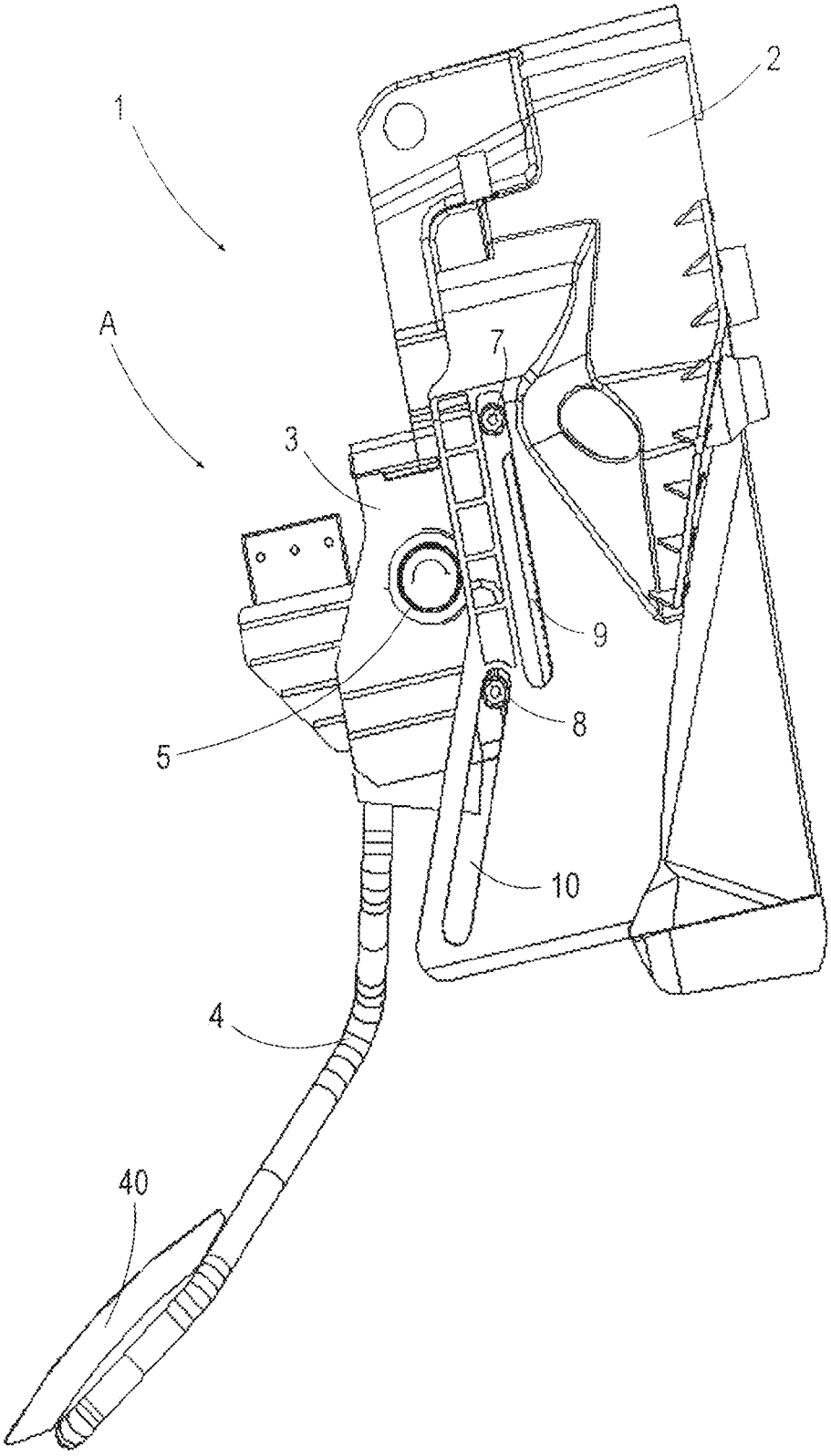
FIG. 3 is a profile view of the embodiment of FIG. 1 with the pedal in the first end position.
Figure 4:
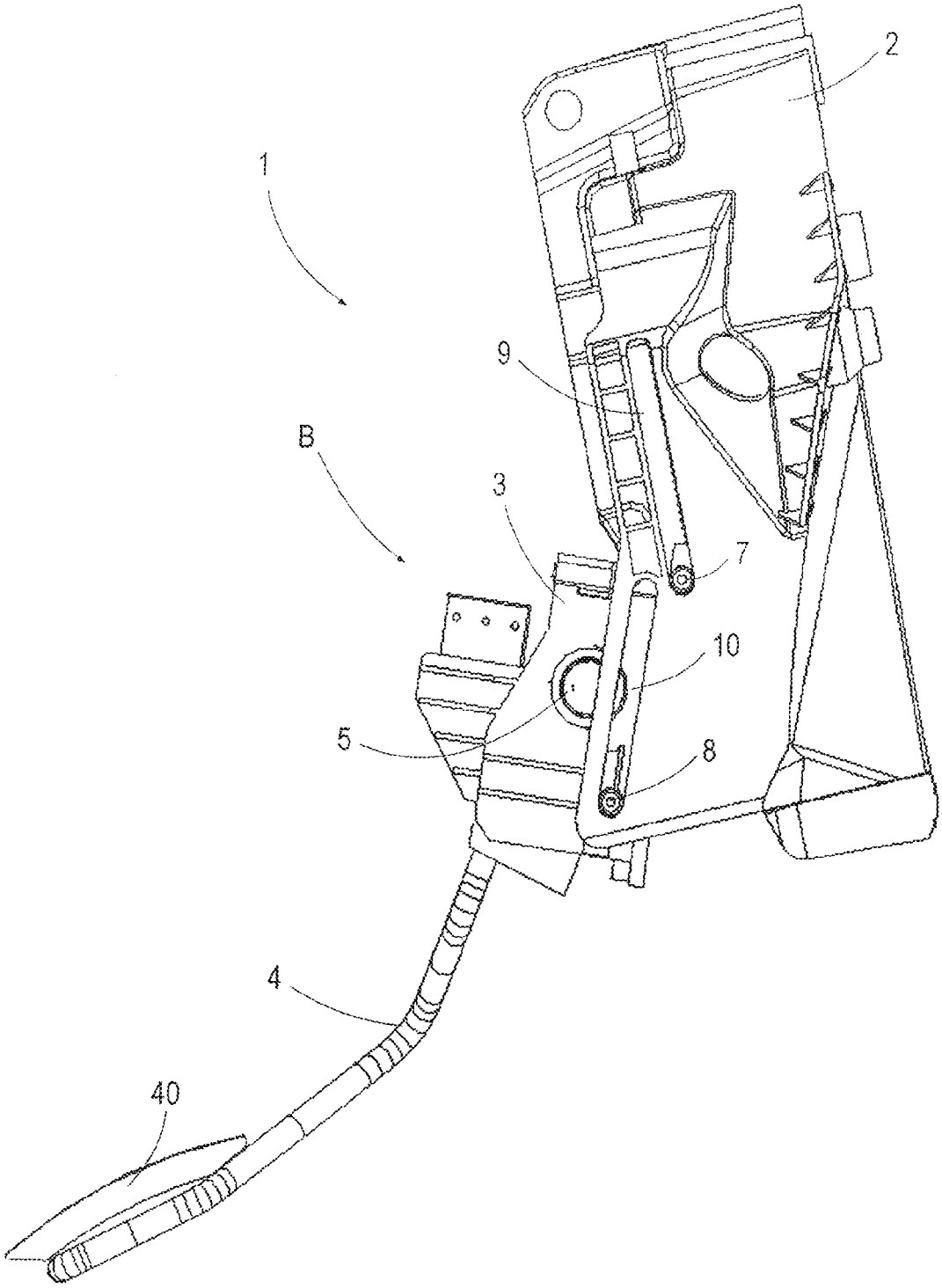
FIG. 4 is a profile view of the embodiment of FIG. 1 with the pedal in the second end position.

Said curvilinear path is defined between a first position A, shown in FIG. 3, in which the pins 7 and 8 are housed in a first end of the respective guide grooves 9 and 10, and a second position B, shown in FIG. 4, in which the pins 7 and 8 are housed in a second end of the respective guide grooves 9 and 10.

During the design of the adjustment mechanism 1, once the positions A and B, which are the end positions of the pedal 4, have been fixed, the intermediate positions of said pedal 4 are determined, in other words, the path that the pedal 4 has to follow between said positions A and B. It is the shape of the guide grooves 9 and 10 that determines said path. In a preferred embodiment, and as it is shown in the figures, said guide grooves 9 and 10 are straight.

Figure 2:
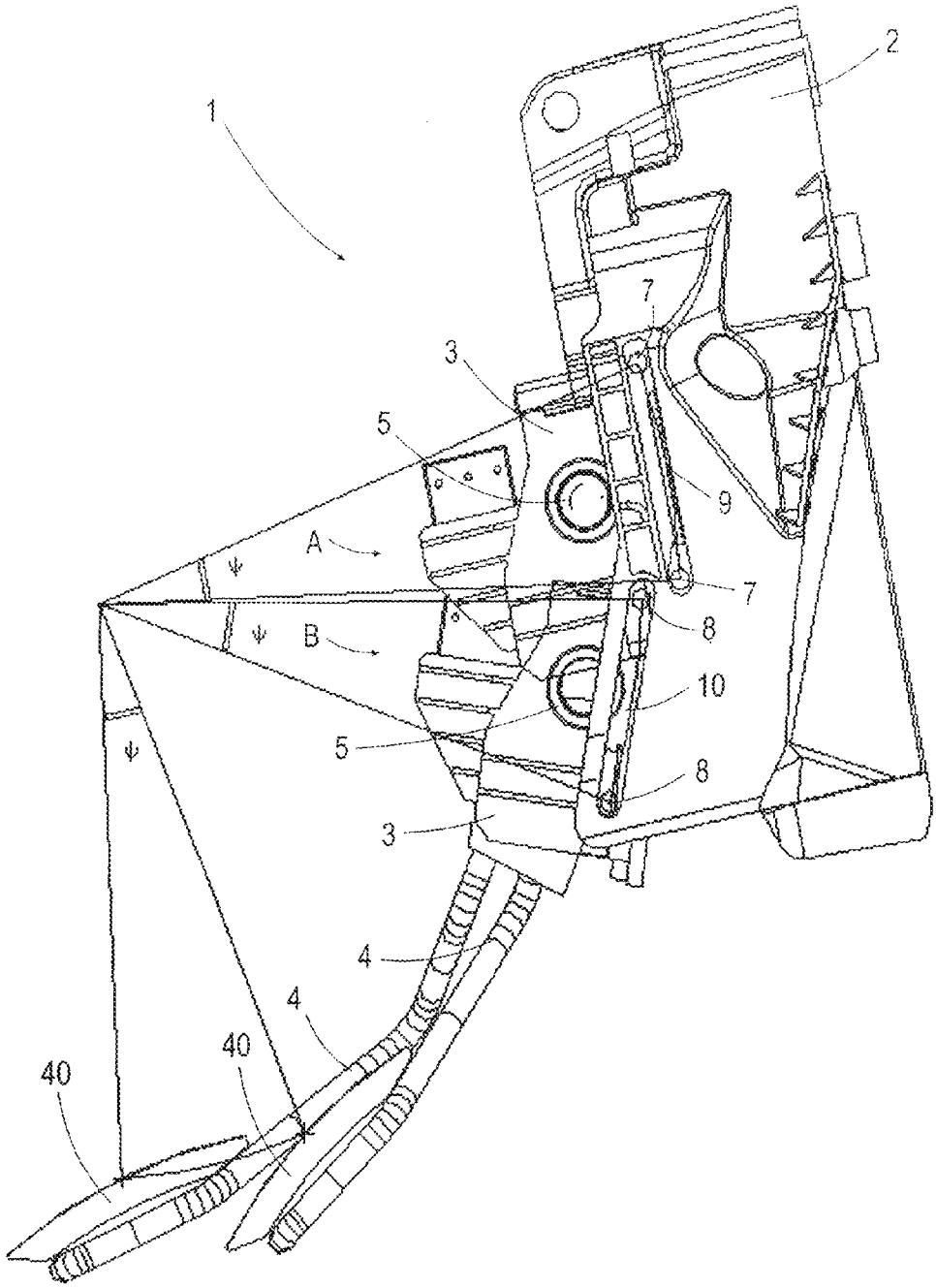
FIG. 2 is a profile view of the embodiment of FIG. 1 in which the two end positions of the pedal are shown superimposed.

In this embodiment, the shoe 40 is moved, as shown in FIG. 2, along a path approximately in the shape of an arc of circumference. In order to obtain a path of said exact shape all that is required is to use grooves 9 and 10 in the shape of an arc of circumference.

Figure 5:
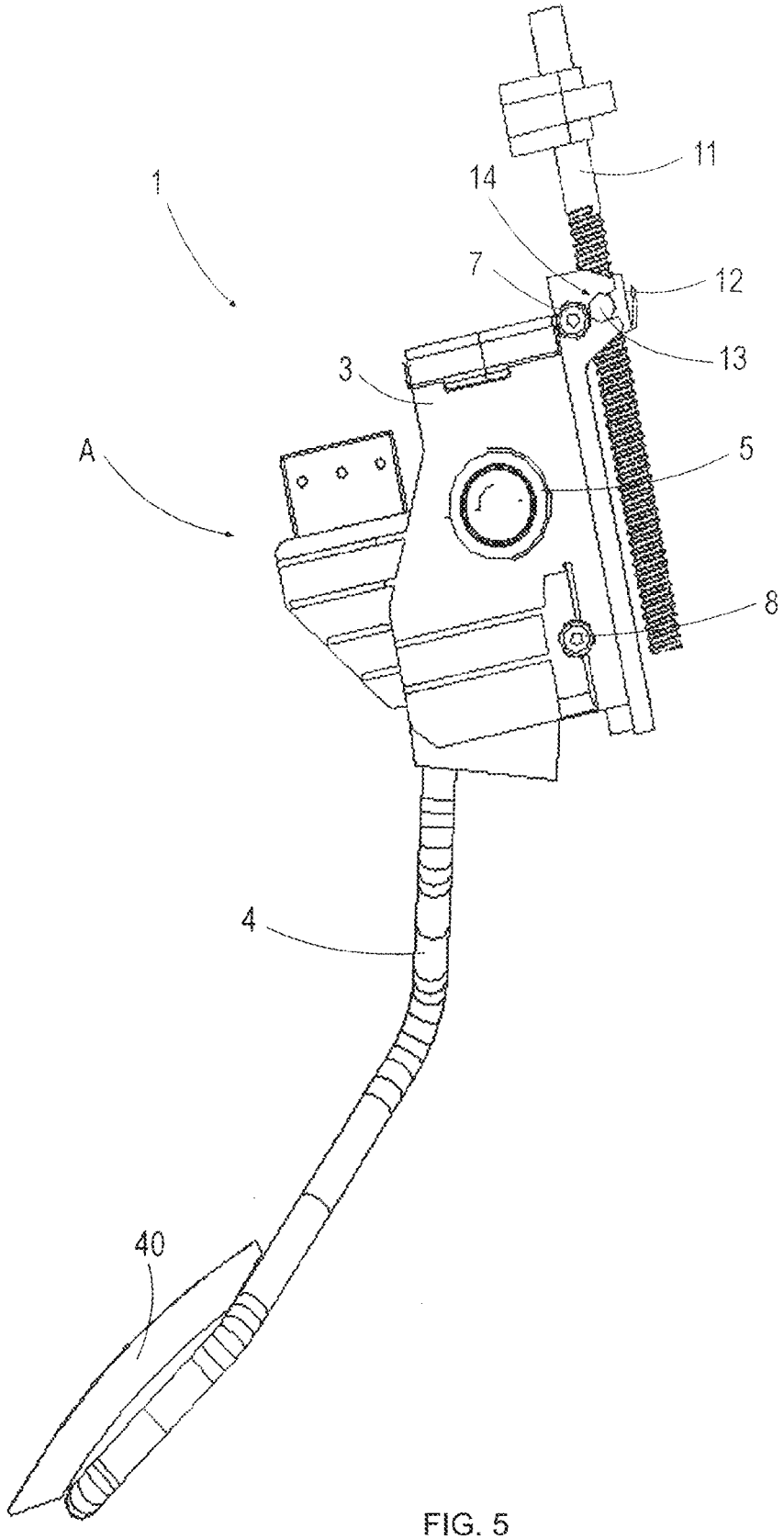
FIG. 5 is the profile view of FIG. 3 without the support piece.
Figure 6:
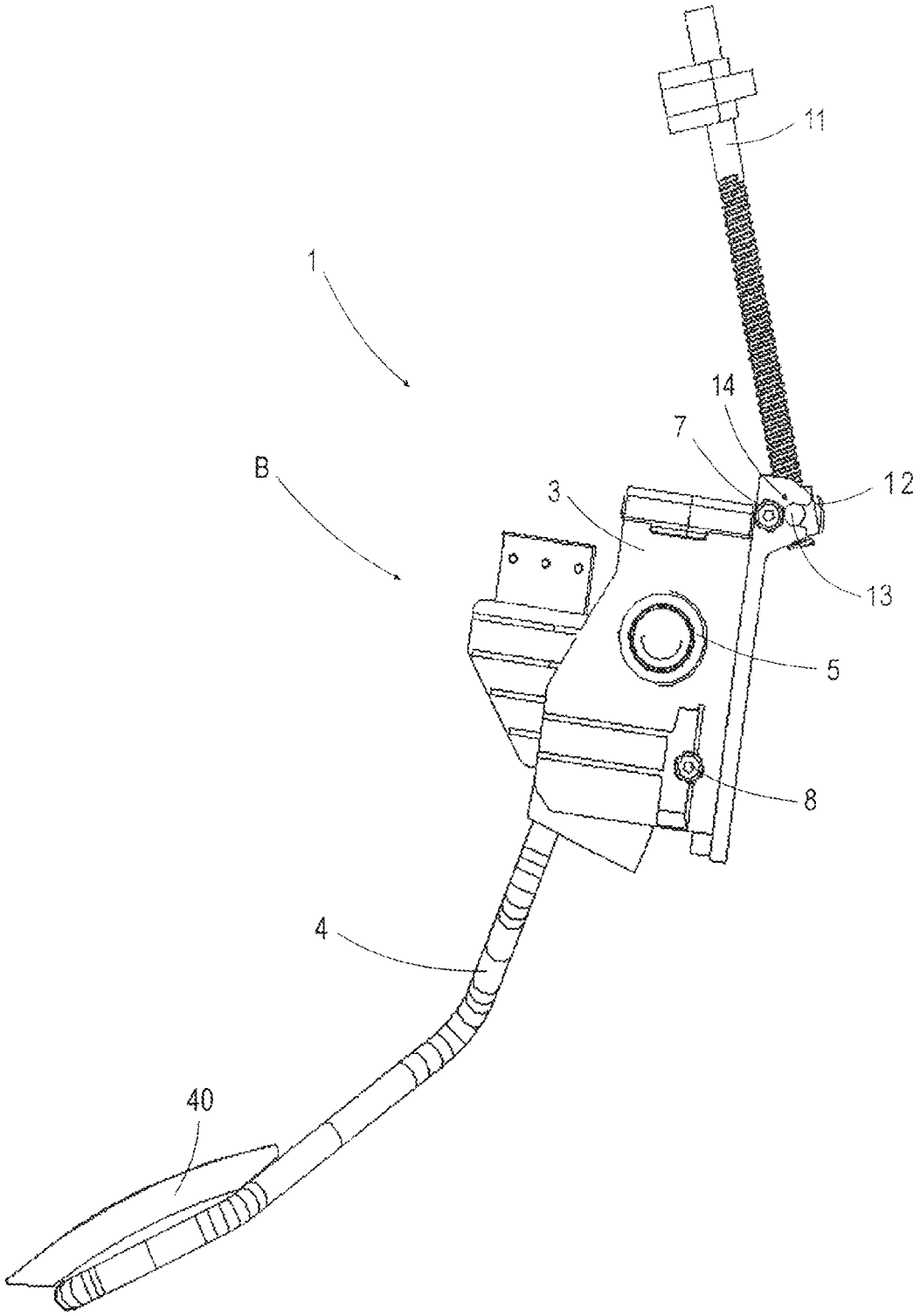
FIG. 6 is the profile view of FIG. 4 without the support piece.

In the embodiment shown in the figures, the actuation means 6 comprise, as can be seen in FIGS. 5 and 6, a screw 11 fixed to the support part 2, a nut 12 threaded on said screw 11 and connected, with the possibility of rotation, to the control part 3, said control part 3 being moved by means of the rotation of the screw 11.

The nut 12 comprises on each side a shaft 13 which fits into respective housings 14 that the control part 3 has, which enables said control part 3 to tilt in relation to said nut 12.

What is claimed is:

1. A motor vehicle pedal adjustment mechanism comprising:

a support part which is fixed to the motor vehicle, a control part which can move in relation to said support part, a pedal rotationally coupled to the control part wherein both the pedal and control part pivot about a rotary shaft connected to said control part when the pedal is operably depressed, a rotatable screw fixed to said support part, a nut threaded on said screw, the nut comprises on each side a shaft that is fitted into respective receptacles on the control part, so that said control part can tilt in relation to said nut, said control part having first and second pins that are vertically displaced from one another, the first and second pins not forming a part of nor extending from or through any part of the pedal, the first and second pins being housed in respective first and second elongate guide grooves situated in a side surface of the support part, the first and second pins guidable along a length of the respective first and second elongate guide grooves, the position of the first and second pins and the position and shape of the first and second elongate grooves causing said control part along with the rotary shaft to be displaced along a curvilinear path when the screw is rotated.

2. A motor vehicle pedal adjustment mechanism according to claim 1, wherein the curvilinear path is defined between a first position, in which the first and second pins are housed in a first end of the respective first and second elongate guide grooves, and a second position, in which the first and second pins are housed in a second end of the respective first and second guide grooves.

3. A motor vehicle pedal adjustment mechanism according to claim 2, wherein each of the first and second elongate guide grooves are straight.

4. A motor vehicle pedal adjustment mechanism according to claim 1, wherein each of the first and second elongate guide grooves are straight.

5. A motor vehicle pedal adjustment mechanism according to claim 1, wherein the first and second elongate guide grooves have different inclinations and are vertically displaced with respect to one another.

6. A motor vehicle pedal adjustment mechanism according to claim 3, wherein the first and second elongate guide grooves have different inclinations and are vertically displaced with respect to one another.

7. A motor vehicle pedal adjustment mechanism according to claim 1, wherein a majority of the first and second elongate guide grooves do not overlap with one another.

8. A motor vehicle pedal adjustment mechanism according to claim 3, wherein a majority of the first and second elongate guide grooves do not overlap with one another.

* * * * *